US008289102B2

(12) United States Patent
Yamamoto et al.

(10) Patent No.: US 8,289,102 B2
(45) **Date of Patent: *Oct. 16, 2012**

(54) DIRECTIONAL COUPLER

(75) Inventors: Kazuya Yamamoto, Tokyo (JP); Miyo Miyashita, Tokyo (JP); Hitoshi Kurusu, Tokyo (JP); Tomoyuki Asada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 298 days.

This patent is subject to a terminal disclaimer.

(21) Appl. No.: 12/781,848

(22) Filed: May 18, 2010

(65) Prior Publication Data

US 2011/0057746 A1 Mar. 10, 2011

(30) Foreign Application Priority Data

Sep. 9, 2009 (JP) ..... 2009-208274

(51) Int. Cl.
*H01P 5/18* (2006.01)
*H01P 1/18* (2006.01)

(52) U.S. Cl. ..... 333/116; 333/246

(58) Field of Classification Search ..... 333/109, 333/110, 111, 112, 115, 116, 246
See application file for complete search history.

(56) References Cited

U.S. PATENT DOCUMENTS

| | | | | |
|---|---|---|---|---|
| 4,999,593 | A * | 3/1991 | Anderson | 333/112 |
| 7,218,186 | B2 * | 5/2007 | Chen | 333/116 |
| 7,907,032 | B2 * | 3/2011 | Yamamoto et al. | 333/116 |

FOREIGN PATENT DOCUMENTS

| | | | |
|---|---|---|---|
| JP | 5-41206 | U | 6/1993 |
| JP | 2007-194870 | A | 8/2007 |

* cited by examiner

*Primary Examiner* — Dean O Takaoka
(74) *Attorney, Agent, or Firm* — Leydig, Voit & Mayer, Ltd.

(57) ABSTRACT

A directional coupler includes capacitive elements electrically connected to a coupled port and an isolated port, respectively, for a coupled line on a chip (on-chip). The capacitive elements serve as matching capacitive elements and may be MIM (Metal Insulator Metal) capacitors on a substrate. A first end of a first of the capacitive elements is connected between the coupled port and the coupled line and a second end is grounded. A first end of a second of the capacitive elements is connected between the isolated port and the coupled line and a second end is grounded.

5 Claims, 11 Drawing Sheets

DIRECTIONAL COUPLER

FIELD OF THE INVENTION

The present invention relates to a directional coupler.

BACKGROUND ART

Directional couplers have been used in various applications. FIG. 17 shows an exemplary application of a directional coupler, specifically, a typical system in a cellular phone unit which includes a power amplifier (or PA), a directional coupler, and a wave detecting circuit. The reference symbol ANT denotes an antenna. The system shown in FIG. 17 is adapted to monitor power through the directional coupler. In this system, the forward power from the PA can be accurately monitored by greatly reducing the influence of the mismatch in impedance at the antenna terminal on the detected voltage by virtue of the directivity of the directional coupler. Such monitoring systems are often used in GSM (Global System for Mobile Communications) terminals, which are widely used overseas, and in CDMA terminals. However, they are not limited to use in terminals, but are the most common systems for monitoring transmission power.

FIG. 18 shows an exemplary relationship between the directivity of the directional coupler and the error in the power measurement. Specifically, FIG. 18 shows, as a function of the directivity of the directional coupler, the calculated error in the forward power measurement obtained from the signal power appearing at the coupled port CPL when the system is operated under the mismatched load condition that VSWR=4:1. When a main signal is transmitted from the input port IN to the output port OUT through the directional coupler, part of the forward power can be coupled out to the coupled port CPL to monitor this forward power, or transmission power. FIG. 18 indicates that in order to achieve a measurement error of less than 0.5 dB, the directional coupler must have a directivity of more than 20 dB.

The degree to which the input port IN is coupled to the coupled port is referred to as "coupling" or "coupling factor." That is, the coupling is the ratio of the CPL signal power to the IN signal power and is typically approximately −10 dB to −20 dB.

A mismatch in impedance at the output port OUT results in some reflection of the signal at that port, so that a reflected wave travels back from the output port OUT to the input port IN. At that time, part of the input wave (reflected wave) to the output port OUT is absorbed in the isolated resistance. (That is, the relationship between the output port OUT and the isolated port is similar to that between the input port IN and the coupled port CPL.) A reflected wave component also appears at the coupled port. The term "isolation" as used in the art refers to the ratio of the signal power appearing at the coupled port to the signal power input to the output port OUT (i.e., CPL signal power/OUT input power [dB]). Directional couplers typically provide an isolation of approximately −15 dB to −30 dB.

Directivity is defined as the ratio of coupling to isolation and is expressed in dB. The higher the directivity, the less the reflected wave power appearing at the coupled port. That is, when the directional coupling has high directivity, substantially only a forward wave component is allowed to appear at the coupled port. The error in the forward power measurement becomes smaller as the directivity increases, as shown in FIG. 18, since the influence of the reflected wave on the wave detecting circuit decreases. This means that it is possible to accurately monitor the forward power by use of the wave detecting circuit even under load variations. That is, the reduction in the reflected wave component of the voltage detected by the wave detecting circuit results in reduced error in the forward power measurement. This prevents the PA from outputting excessive power under load variations, thereby preventing radiation of distorted components.

FIG. 19 shows an exemplary application of power amplifiers and directional couplers. This circuit is often used in cellular phone units with multiband capability, which are growing rapidly in number in recent years. The reference symbols PA1 to PA3 denote power amplifiers designed to operate in different operating bands, and a directional coupler is connected to each of these power amplifiers. This circuit is characterized by the following: the coupled lines (or sub-lines) of the directional couplers connected to the power amplifiers PA1, PA2, and PA3 are connected in series in that order between a terminating resistance of 50 O and an RF-IC (a circuit) including a wave detecting circuit; the isolated port C12 of the coupled line of the directional coupler connected to the power amplifier PA1 is connected to the terminating resistance to terminate the isolated port C12; and the coupled port C31 of the directional coupler connected to the power amplifier PA3 is connected to the RF-IC. Such an interconnection is referred to as a "daisy-chain."

When implemented on a substrate, this daisy-chain configuration provides simpler circuitry than does a configuration in which the isolated ports C12, C22, and C32 of three directional couplers (such as shown in FIG. 17), respectively, are terminated separately and the coupled ports C11, C21, and C31 of these three directional couplers, respectively, are connected to a switch for selectively connecting one of the coupled ports to the monitoring wave detecting circuit. This daisy-chain configuration is also advantageous in that only one of the power amplifiers (Pas) is operated at one time when the terminal is in operation. That is, the wave detecting circuit monitors the output power of this operating PA. Therefore, in principle no problem is presented even if the output power of each power amplifier is monitored through the coupled lines of the directional couplers for other power amplifiers which are designed to operate in a different operating band than that power amplifier.

Prior art includes Japanese Laid-Open Patent Publication No. 2007-194870 and Japanese Utility Model Laid-Open Patent Publication No. 5-41206 (1993).

FIG. 20 is an equivalent circuit of a directional coupler and components connected thereto. Specifically, this circuit represents a small directional coupler formed on a GaAs substrate together with a power amplifier, and this chip is mounted on a module substrate. FIG. 21 is an exemplary circuit pattern of the circuit shown in FIG. 20. Referring to FIG. 20, the reference symbols IN and OUT denote the input port and the output port, respectively, of the main line 214 of the directional coupler, and CPL and ISO denote the coupled port and the isolated port, respectively, of the coupled line 220 of the directional coupler. The reference symbols Lw1 and Lw2 denote the inductances of the bonding wires connected between the directional coupler on the chip and the module substrate.

FIG. 22 shows the reflection loss in the chip with or without the wires. In FIG. 22, the reference symbol "S33*w/o*-L, S44*w/o*-L" represents the reflection loss in the chip without the wires. The reference symbol "S33with-L, S44with-L," on the other hand, represents the reflection loss in the chip with the wires attached. As shown in FIG. 22, the addition of the wires (which have an inductance) to the chip results in a significant increase in the reflection loss in the chip. This reflection loss increase is approximately 10-15 dB.

The degradation of the reflection loss characteristics of the coupled line as shown in FIG. 22 presents a problem when the coupled lines of several directional couplers are connected in series, as shown in FIG. 19, to achieve multiband capability. That is, referring to FIG. 19, degradation of the reflection loss characteristics of any one of the three coupled lines results in degradation of the combined reflection loss characteristics of the three coupled lines as measured from the RF-IC side. This degradation of the combined reflection loss characteristics will result in manufacturing variations and degradation in the wave detection characteristics of the wave detecting circuit when mounted on the board of the terminal. Therefore, when the coupled lines of several directional couplers are connected in series with one another as shown in FIG. 19 in order to achieve multiband capability, it is necessary to address the problem of degradation of the reflection loss characteristics of the coupled lines.

Thus, when a plurality of coupled lines are connected in series with one another, as in the configuration shown in FIG. 19, it is necessary to improve the reflection loss characteristics of each coupled line over the entire bands in which the power amplifiers PA1 to PA3 operate, as well as to improve the directivity of the directional couplers. However, the bonding wires connected to the chip act to greatly increase the reflection loss in the chip, as described above with reference to FIG. 22. Therefore, it has been difficult to improve the reflection loss characteristics of the coupled lines of directional couplers with inductive connecting elements, such as wires, connected thereto over a wide band.

SUMMARY OF THE INVENTION

The present invention has been made to solve the above problems. It is, therefore, an object of the present invention to provide a directional coupler whose coupled line has improved reflection loss characteristics.

According to one aspect of the present invention, a directional coupler includes a main line, a coupled line, a first capacitive element and a second capacitive element. The main line is formed on a substrate. The main line is connected at one end to an input port and at the other end to an output port. The coupled line is provided on the substrate and extending along the main line. One end of the coupled line is located at the same side of the directional coupler as the input port and connected to a coupled port. The other end of the coupled line is located at the same side of the directional coupler as the output port and connected to an isolated port. The first capacitive element is provided on the substrate. The first capacitive element is connected at one end between the coupled port and the one end of the coupled line and at the other end to ground. The second capacitive element is provided on the substrate. The second capacitive element is connected at one end between the isolated port and the other end of the coupled line and at the other end to ground.

When the directional coupler of the present invention is mounted, e.g., on a module substrate so that the coupled port and the isolated port of the coupler are connected to the module substrate by connecting members, the first and second capacitive elements of the directional coupler are electrically connected to these connecting members. This allows the parasitic inductive component of the connecting members to resonate with the capacitive component of the first and second capacitive elements so as to ensure that the coupled line exhibits good reflection loss characteristics over a wide band.

DETAILED DESCRIPTION OF THE PREFERRED EMBODIMENTS

First Embodiment

Preferred embodiments of the present invention will be described in connection with a configuration in which a chip with a directional coupler thereon is mounted on a module substrate or a printed board. The chip with a directional coupler thereon can be manufactured by a GaAs-HBT process, a GaAs-BiFET (HBT+FET or HBT+HEMT) process, or a GaAs-HEMT/FET process. The coupled port and the isolated port of the directional coupler are both connected to a component or device outside the module. This connection is accomplished through inductive connecting elements, such as bonding wires, and transmission lines in the module substrate. It should be noted that the embodiments described below can also be applied to directional couplers manufactured by a Si-based process. Further, these embodiments are suitable as applied to the case where the coupled lines (also referred to as the "sub-lines") of the directional couplers in a multiband-capable terminal are connected in series with one another.

Figure 1:
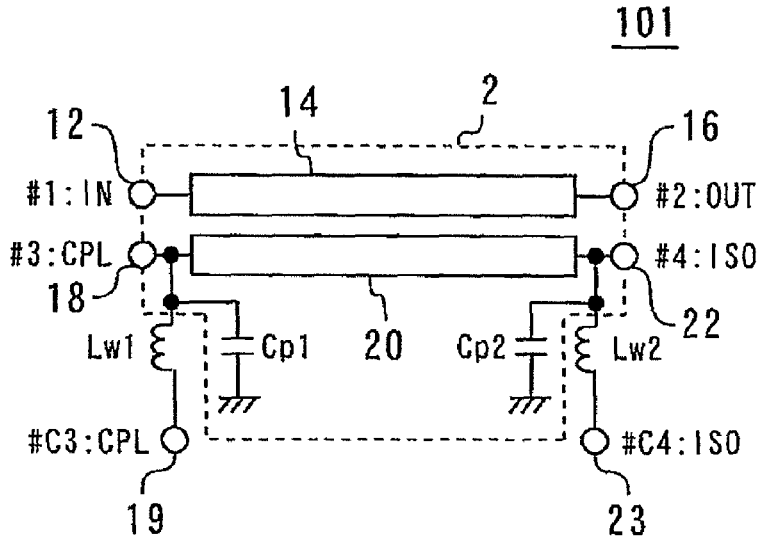
FIG. 1 is a circuit diagram of a directional coupler according to a first embodiment of the present invention.

FIG. 1 is a circuit diagram of a directional coupler 101 according to a first embodiment of the present invention. The directional coupler 101 is formed on a GaAs/Si substrate. In practice, the GaAs/Si chip with the directional coupler 101 thereon is mounted on a module substrate or a printed board. Referring to FIG. 1, the reference symbol IN denotes an input port 12 for the main line 14; OUT, an output port 16 for the main line 14; CPL, a coupled port 18 for the coupled line 20; and ISO, an isolated port 22 for the coupled line 20. In the circuit diagram of FIG. 1, the portion enclosed by broken lines 2 is formed on the GaAs/Si substrate. This portion enclosed by the broken lines 2 is also referred to hereinafter as the "substrate 2," for convenience.

The directional coupler 101 of the present embodiment includes the main line 14 formed on the substrate 2. One end of the main line 14 is connected to the input port 12, and the other end is connected to the output port 16. The main line 14 transmits transmission power (or a forward wave) from the input port 12 to the output port 16. The coupled line 20 is formed on the substrate 2 and extends along the main line 14. One end of the coupled line 20 is connected to the coupled port 18, and the other end is connected to the isolated port 22. The coupled line 20 is a line through which part of the power transmitted in the main line 14 is coupled out to the coupled port. As shown in FIG. 1, the input port 12 and the coupled port 18 are disposed on one side of the substrate 2 (the left side of the substrate 2, as viewed in FIG. 1). Further, the output port 16 and the isolated port 22 are disposed on the opposite side of the substrate 2 (the right side of the substrate 2, as viewed in FIG. 1).

The directional coupler 101 provided on the substrate 2 is mounted on a module substrate or a printed board (not shown). In FIG. 1, the reference symbols Lw1 and Lw2 denote connecting elements having an inductance, specifically, e.g., bonding wires, transmission lines in the module substrate, or support pillars for flip mounting. The coupled port 18 is connected to a coupled port 19 through Lw1, and the isolated port 22 is connected to an isolated port 23 through Lw2.

The directional coupler 101 of the first embodiment includes capacitive elements Cp1 and Cp2. Cp1 and Cp2 are electrically connected to the coupled port 18 and the isolated port 22, respectively, for the coupled line 20. Cp1 and Cp2 serve as matching capacitive elements. In the first embodiment, Cp1 and Cp2 are MIM (Metal Insulator Metal) capacitors formed on the substrate 2 (on-chip). One end of Cp1 is connected between the coupled port 18 and the coupled line 20, and the other end is grounded. On the other hand, one end of Cp2 is connected between the isolated port 22 and the coupled line 20, and the other end is grounded. The actual circuit pattern and the positions and connections of the MIM capacitors on the substrate 2 may be designed so as to form a circuit which is the same as or equivalent to the circuit diagram of FIG. 1.

Figure 2:
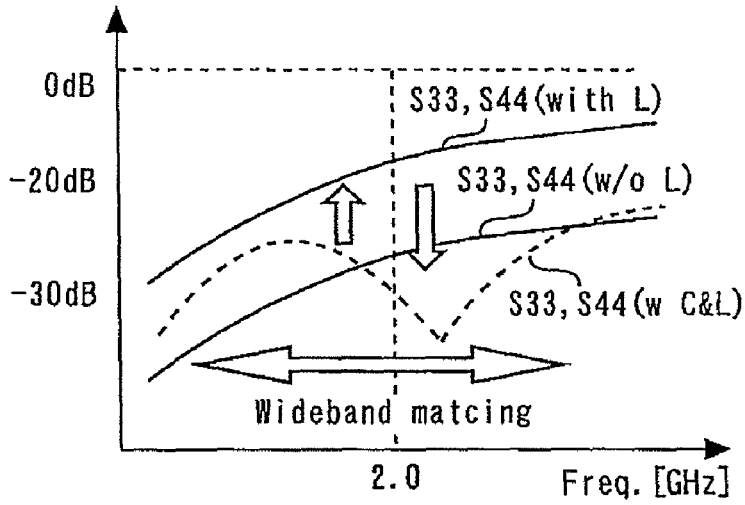
FIG. 2 illustrates a characteristic of a directional coupler according to a first embodiment of the present invention.
Figure 22:
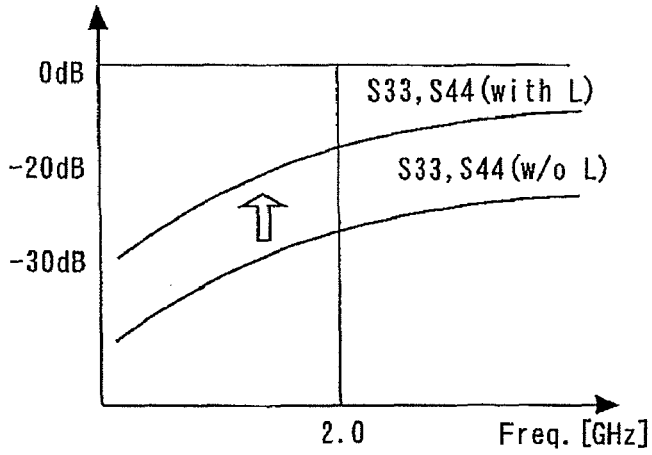
FIG. 22 illustrates an exemplary characteristic of an on-chip type directional coupler.

FIG. 2 illustrates the reflection loss in the coupled line with or without the inductive connecting elements Lw1 and Lw2 and with or without the matching capacitive elements Cp1 and Cp2, indicating how the reflection loss characteristics of the coupled line are degraded by Lw1 and Lw2 and improved by Cp1 and Cp2. As described above with reference to FIG. 22, the connection of Lw1 and Lw2 to the coupling line adversely affects its reflection loss characteristics. As a result, for example, the reflection loss characteristics are changed from those indicated by the reference symbol "S33, S44 (w/o-L)" in FIG. 2 to those indicated by the reference symbol "S33, S44 (with-L)." The reflection loss increase is, e.g., approximately 10 dB. In the directional coupler 101 of the first embodiment, Cp1 and Cp2 are connected to the coupled port and the isolated port, respectively, for the coupled line on the chip. These capacitive elements Cp1 and Cp2 act as matching capacitances to cancel out the effect of Lw1 and Lw2. This greatly reduces the reflection loss increase due to Lw1 and Lw2 and furthermore may improve the reflection loss characteristics of the coupled line over some band, as is the case with the reflection loss characteristics indicated by the reference symbol "S33, S44 (w-C&L)" in FIG. 2. Further, the coupled line can have good reflection loss characteristics, namely, a reflection loss of −20 dB or less, over a relatively wide band (e.g., a band of approximately 0.8-2.5 GHz). It should be noted that when the inductance of the wires is, e.g., 0.6-1.0 nH, the capacitance value of Cp1 and Cp2 must be approximately 0.2-0.4 pF. Thus, the required capacitance value is very small.

As described above, the coupled line in the directional coupler of the present embodiment has improved reflection loss characteristics over a wide band.

In a multiband-capable terminal in which the coupled lines of the directional couplers are connected in series with one another, these directional couplers may be of the type of the present embodiment. This makes it possible to prevent degradation of the reflection loss characteristics of each coupled line, which degradation is particularly problematic in multiband-capable terminals in which the coupled lines of the directional couplers are connected in series with one another. That is, a plurality of the directional couplers 101 of the first embodiment may be used, instead of conventional directional couplers, and the coupled lines of these directional couplers may be connected to one another in daisy-chain fashion. This makes it possible to reduce degradation of the reflection loss characteristics of each coupled line (which degradation is particularly problematic when the coupled lines are connected in series with one another) while enjoying the advantages of daisy-chain connection.

Second Embodiment

Figure 3:
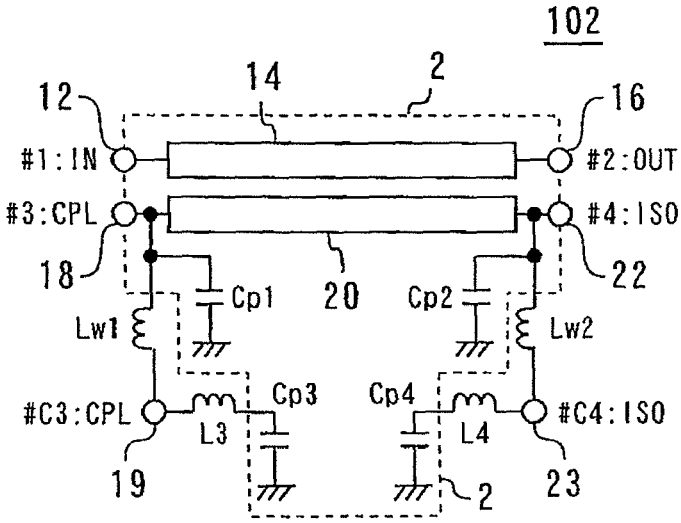
FIG. 3 is a circuit diagram of a directional coupler according to a second embodiment of the present invention.

FIG. 3 is a circuit diagram of a directional coupler 102 according to a second embodiment of the present invention. This directional coupler 102 differs from the directional coupler 101 of the first embodiment in that it additionally includes inductances L3 and L4 and capacitive elements Cp3 and Cp4. L3 and L4 are the parasitic inductances of connecting elements. That is, each matching circuit to the coupled line 20 of the directional coupler 102 is an LCLC circuit and includes 4 components, whereas each matching circuit to the coupled line of the directional coupler 101 of the first embodiment shown in FIG. 1 is an LC circuit and includes 2 components. This increase in the number of components allows the reflection loss characteristics of the coupled line to be improved over a wider band, as compared with the first embodiment.

Third Embodiment

Figure 4A:
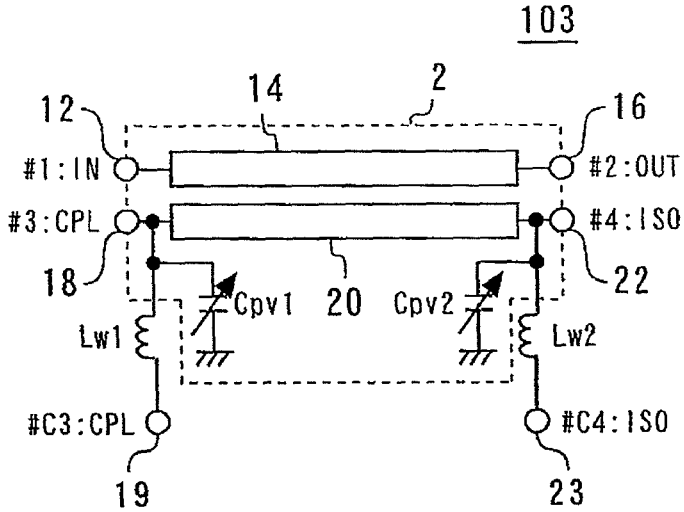
FIG. 4 is a circuit diagram of a directional coupler according to a third embodiment of the present invention.
Figure 4B:
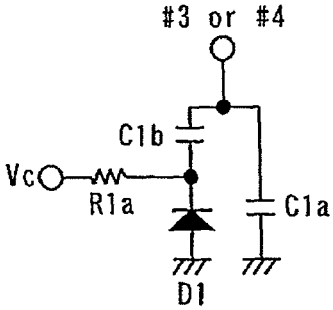

FIG. 4, which includes FIGS. 4A and 4B, is a circuit diagram of a directional coupler 103 according to a third embodiment of the present invention. This directional coupler 103 differs from the directional coupler 101 shown in FIG. 1 in that the capacitive elements Cp1 and Cp1 are replaced by variable capacitance elements Cpv1 and Cpv2, respectively, as shown in FIG. 4A. FIG. 4B shows the actual circuit configuration of the variable capacitance elements Cpv1 and Cpv2. As shown in FIG. 4B, each of Cpv1 and Cpv2 includes a resistance R1*a*, a capacitance Cb1, a variable capacitance diode D1, and a fixed value capacitance C1*a*. The capacitance of Cpv1 and Cpv2 can be varied by varying the control voltage Vc. This makes it possible to vary the reflection characteristics of the coupled line (which characteristics correspond to those indicated by the reference symbol "S33, S44 (w-C&L)" in FIG. 2), allowing the characteristics to be adjusted finely or over a selected band even after mounting of the directional coupler. Further, the third embodiment also has all the other advantages of the first embodiment.

Fourth Embodiment

Figure 5:
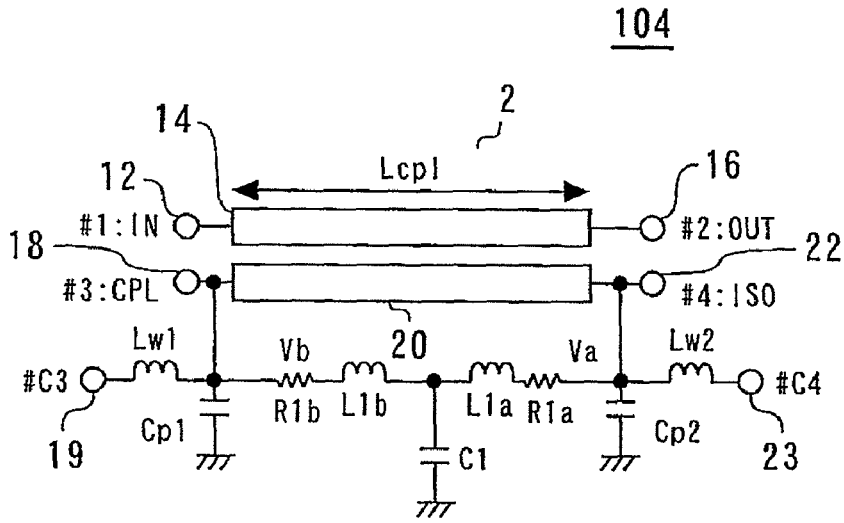
FIG. 5 is a circuit diagram of a directional coupler according to a fourth embodiment of the present invention.

FIG. 5 is a circuit diagram of a directional coupler 104 according to a fourth embodiment of the present invention. This directional coupler 104 differs from the directional coupler 101 of the first embodiment in that it includes a phase shifter as described below. In FIG. 5, the reference symbol Lcp1 denotes the coupling length between the main line 14 and the coupled line 20. The coupling length Lcp1 is approximately one-tenth (1/10) to one-twentieth (1/20) of λ/4, where λ is the wavelength of the frequency of the power transmitted through the main line 14.

Referring to FIG. 5, the reference symbols R1*a* and R1*b* denote resistances, L1*a* and L1*b* denote inductances, and C1 denotes a capacitive element. In FIG. 5, these components R1*a*, R1*b*, L1*a*, L1*b*, and C1 together form a 180° phase shifter and an attenuator which serve to improve the directivity of the directional coupler at a particular frequency. The configuration of this phase shifter is also disclosed in detail in Japanese Patent Application No. 2009-874. The capacitive elements Cp1 and Cp1 in the directional coupler of the fourth embodiment also act as matching capacitances, allowing the directional coupler to have the same advantages as described in connection with the first embodiment.

One end of R1*b* is connected between the coupled port side-end of the coupled line 20 and the inductance Lw1. This end of R1*b* is also connected to one end of Cp1. Further, one end of R1*a* is connected between the isolated port side-end of the coupled line 20 and the inductance Lw2. This end of R1*a* is also connected to one end of Cp2. A series connection of L1*b* and L1*a* is connected between the other end of R1*b* and the other end of R1*a*. One end of C1 is connected between L1*b* and L1*a*, and the other end of C1 is grounded.

The reflected wave component traveling from the output port 16 to the coupled port 18 through the coupled line 20 is also referred to herein as the "first reflected wave component," for convenience. Further, the reflected wave component traveling from the output port 16 to the coupled port 18 through the isolated port 22 and the phase shifter is also referred to herein as the "second reflected wave component," for convenience. The phase shifter shown in FIG. 5 phase shifts the second reflected wave component using resonance therein so that the second reflected wave component is opposite in phase to the first reflected wave component.

Generally, the performance of a directional coupler is determined by its coupling, isolation, and directivity. The coupling is the degree to which the coupled port 18 is coupled to the input port 12. That is, the coupling is the signal power output from the coupled port 18 divided by the signal power input to the input port 12. The isolation is the degree to which the reflected wave from the output port 16 is coupled to the coupled port 18. That is, the isolation is the reflected wave signal power input to the coupled port 18 divided by the power of the reflected wave output from the output port 16.

The directivity is the ratio of the coupling to the isolation. The higher the directivity, the less the influence of the reflected wave from the output port 16 on the detection of the transmission power and hence the smaller the error in the transmission power measurement using the directional coupler.

The combination of the phase shifter and the attenuator of the present embodiment has a symmetrical circuit configuration, specifically, an R-L-C-L-R circuit configuration, as shown in FIG. 5. The reason for this is so that the reflection loss characteristics of the coupled line are improved in a symmetric fashion. That is, this symmetrical circuit configuration allows improving the characteristics of the coupled port side and the isolated port side of the coupled line equally. This configuration is suitable for improving the reflection loss characteristics of the coupled lines (or sub-lines) of directional couplers connected to one another in daisy-chain fashion.

There is a need to reduce the size of directional couplers. If, in order to meet this need, the coupling length between the main line and the coupled line of a directional coupler is made shorter than λ/4, there might be a decrease in the directivity. However, the present embodiment allows the directivity of a directional coupler to be increased even if its coupling length is shorter than λ/4. That is, since the phase shifter phase shifts the second reflected wave so that the second reflected wave is substantially opposite in phase to the first reflected wave, the decibel value of the isolation (S32) is high over some frequency range. As a result, the directional coupler has high directivity over this frequency range. This frequency range can be arbitrarily changed by changing the resonant frequency (a circuit parameter) of the phase shifter.

Figure 6:
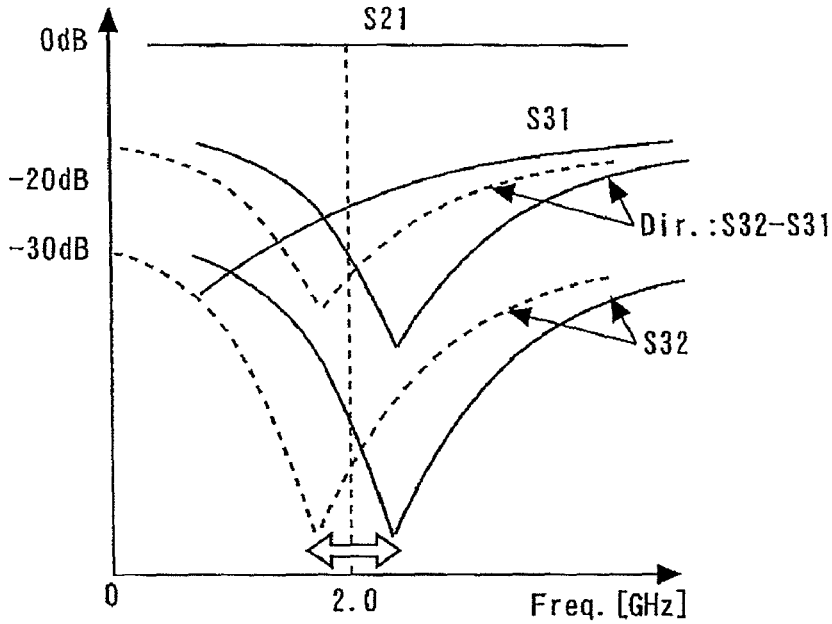
FIG. 6 illustrates a characteristic of a directional coupler according to a fourth embodiment of the present invention.

It should be noted that in a variation of the fourth embodiment, the capacitive element C1 in the phase shifter of the directional coupler 104 may be replaced by a variable capacitance element. For example, this variable capacitance element may have the same circuit configuration as that of Cpv1 and Cpv2 shown in FIG. 4. FIG. 6 is a diagram illustrating the effect obtained when the capacitive element C1 of the directional coupler 104 is replaced by a variable capacitance element. The resonant frequency of the phase shifter can be changed by adjusting the control voltage (Vc in FIG. 4) of the variable capacitance element and thereby changing the capacitance value of the element. Therefore, the frequency range over which the directional coupler has high directivity can be varied, as indicated by the arrow in FIG. 6. This directional coupler is particularly useful in multiband applications (using a plurality of different frequencies).

Fifth Embodiment

Figure 7:
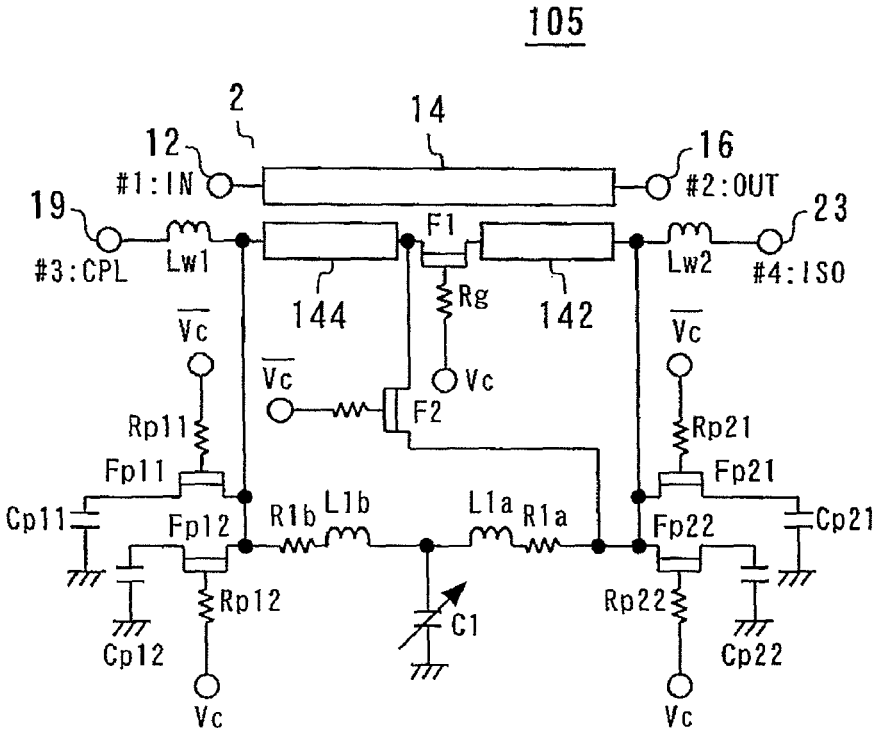
FIG. 7 is a circuit diagram of a directional coupler according to a fifth embodiment of the present invention.

FIG. 7 is a circuit diagram of a directional coupler 105 according to a fifth embodiment of the present invention. The present embodiment relates to a directional coupler having a variable coupling length. Specifically, the directional coupler 105 of the present embodiment is capable of dual band operation and also includes matching capacitances of the type described in connection with the first embodiment. The term "dual band operation" refers to operation in two bands, namely, low and high bands.

Referring to FIG. 7, the reference symbols Cp11, Cp12, Cp21, and Cp22 denote capacitive elements serving as matching capacitances, and the reference symbols F1, F2, Fp11, Fp12, Fp21, and Fp22 denote FET switching devices. In this embodiment the coupled line includes a coupled port-side coupled line 144 and an isolated port-side coupled line 142. The switching device F1 is connected between one end of the coupled port-side coupled line 144 and one end of the isolated port-side coupled line 142 so that these coupled lines 144 and 142 can be electrically connected to and disconnected from each other. Further, the switching device F2 is connected between one end of the phase shifter and the one end of the coupled port-side coupled line 144. One end of Cp11 is connected between a coupled port 19 and the other end of the coupled port-side coupled line 144 through Fp11, and the other end of Cp11 is grounded. One end of Cp12 is connected between the coupled port 19 and the other end of the coupled port-side coupled line 144 through Fp12. The other end of Cp12 is grounded. One end of Cp21 is connected between an isolated port 23 and the other end of the isolated port-side coupled line 142 through Fp21. The other end of Cp21 is grounded. One end of Cp22 is connected between the isolated port 23 and the other end of the isolated port-side coupled line 142 through Fp22. The other end of Cp22 is grounded. Fp11, Fp12, Fp21, and Fp22 may be turned on and off so that selected ones of Cp11, Cp12, Cp21, and Cp22 serve as matching capacitances.

Figure 8:
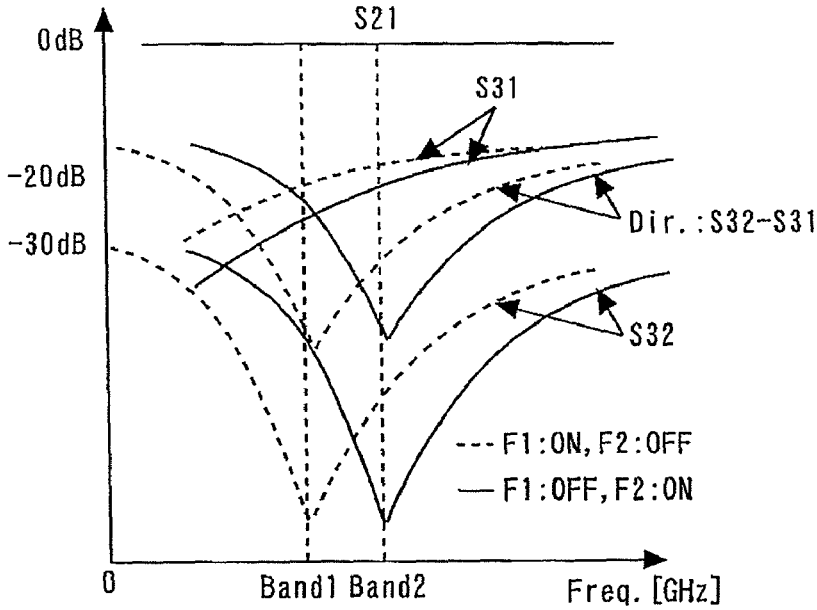
FIG. 8 illustrates a characteristic of a directional coupler according to a fifth embodiment of the present invention.

The operation of this circuit will be briefly described. When F1 is on and F2 is off, the coupled port-side coupled line 144 and the isolated port-side coupled line 142 are electrically connected in series with each other and together act as a single longer coupled line (referred to herein as the "first operating state"). In FIG. 8, the characteristics of the directional coupler in this state are indicated by broken lines. When F1 is off and F2 is on, on the other hand, the isolated port-side coupled line 142 is electrically disconnected from the coupled port-side coupled line 144 and only the coupled port-side coupled line 144 functions as a coupled line (referred to herein as the "second operating state"). The characteristics of the directional coupler in this state are represented by solid lines in FIG. 8. As shown in FIG. 8, the directional coupler has different characteristics when in the first operating state and when in the second operating state. Therefore, this directional coupler may be set in the first operating state when the directional coupler is used in a first band Band1, and may be set in the second operating state when the directional coupler is used in a second band Band2, thus achieving dual band operation.

When the directional coupler is used in Band1, the voltage applied to each transistor is adjusted so that F1, Fp12, and Fp22 are turned on and F2, Fp11, and Fp21 are turned off. This greatly improves the directivity of the directional coupler over the band Band1, as shown in FIG. 8. Since Fp12 and Fp22 are on and Fp11 and Fp21 are off, Cp12 and Cp22 function as matching capacitances. The values of these matching capacitances may be such that the inductances Lw1 and Lw2 resonate with Cp12 and Cp22, respectively, so as to reduce the reflection loss in the coupled lines. This improves the reflection loss characteristics of the coupled lines, as in the case shown in FIG. 2, over a wide range.

When the directional coupler is used in Band2, the voltage applied to each transistor is adjusted so that F1, Fp12, and Fp22 are turned off and F2, Fp11, and Fp21 are turned on. When F1 is off and F2 is on, the directional coupler operates in the second operating state in which only the coupled port-side coupled line 144 functions as a coupled line. Since Fp12 and Fp22 are off and Fp11 and Fp21 are on, Cp11 and Cp21 function as matching capacitances. The values of these matching capacitances may be such that Lw1 and Lw2 resonate with Cp11 and Cp21, respectively, so as to reduce the reflection loss in the coupled line 144. This improves the reflection loss characteristics of the coupled line 144 over a wide range when the directional coupler is operated in Band2.

It is preferable to equalize the coupling of a directional coupler between the plurality of bands in which the coupler is operated. Therefore, the directional coupler of the present embodiment is adapted to be able to have different coupling lengths when in different bands, namely, Band1 and Band2. This equalizes the coupling of the directional coupler between Band1 and Band2. It should be noted that, like Cp1 and Cp2 of the first embodiment, Cp11, Cp12, Cp21, and Cp22 may be MIM capacitors.

Sixth Embodiment

Figure 9:
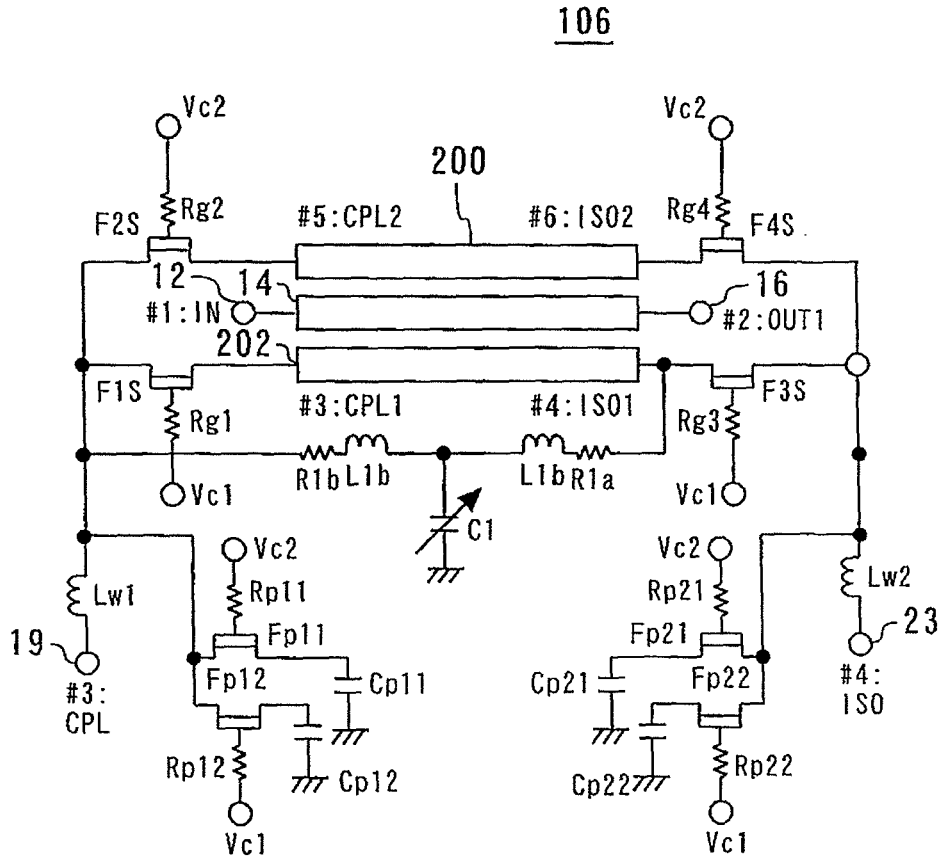
FIG. 9 is a circuit diagram of a directional coupler according to a sixth embodiment of the present invention.

FIG. 9 is a circuit diagram of a directional coupler 106 according to a sixth embodiment of the present invention. The directional coupler 106 of the present embodiment is capable of dual band operation and also includes matching capacitances of the type described in connection with the first embodiment. The directional coupler 106 differs from the directional coupler 105 of the fifth embodiment in that it includes two long parallel coupled lines extending along the main line, instead of a series connection of two short coupled lines extending along the main line. In this configuration, the two coupled lines may be spaced at difference distances from the main line to allow the directional coupler to operate in two bands.

The main line 14 is sandwiched between a second band coupled line 200 and a first band coupled line 202. One end of the first band coupled line 202 is connected to an inductance Lw1 through an FET switching device F1S. The other end of the first band coupled line 202 is connected to an inductance Lw2 through an FET switching device F3S. On the other hand, one end of the second band coupled line 200 is connected to Lw1 through an FET switching device F2S. The other end of the second band coupled line 200 is connected to Lw2 through an FET switching device F4S.

One end of a capacitive element Cp11 is connected to the coupled port through an FET switching device Fp11, and the other end is grounded. One end of a capacitive element Cp12 is connected to the coupled port through an FET switching device Fp12, and the other end is grounded. Further, one end of a capacitive element Cp21 is connected to the isolated port through an FET switching device Fp21, and the other end is grounded. One end of a capacitive element Cp22 is connected to the isolated port through an FET switching device Fp22, and the other end is grounded. Like Cp1 and Cp2 of the first embodiment, Cp11, Cp12, Cp21, and Cp22 may be MIM capacitors.

When one of the two coupled lines (i.e., the first band coupled line 202 and the second band coupled line 200) is to be used, the FET switching devices connected to or associated with that coupled line are turned on and the FET switching devices connected to or associated with the other coupled line are turned off. For example, when the directional coupler is used in a first band Band 1, the switching devices F1S, F3S, Fp11, and Fp21 are turned on and the switching devices F2S, F4S, Fp12, and Fp22 are turned off. When the directional coupler is used in a second band Band2, on the other hand, the switching devices F1S, F3S, Fp11, and Fp21 are turned off and the switching devices F2S, F4S, Fp12, and Fp22 are turned on.

Figure 10:
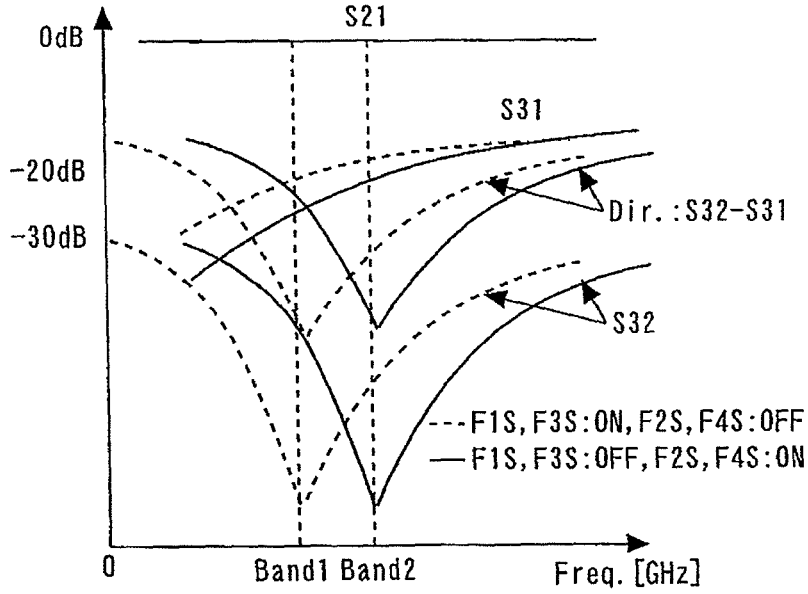
FIG. 10 illustrates a characteristic of a directional coupler according to a sixth embodiment of the present invention.

The directional coupler includes a phase shifter and an attenuator for improvement of the directivity, as in the fourth and fifth embodiments. The switching devices connected to the capacitive elements may be turned on and off so that selected ones of these capacitive elements serve as matching capacitances to improve the directivity of the directional coupler, as shown in FIG. 10, and improve the reflection characteristics of the coupled line, as in the case shown in FIG. 2, over a wide band.

The first band coupled line 202 may be spaced a shorter distance from the main line 14 than is the second band coupled line 200. That is, a relatively small distance may be provided between the main line 14 and the first band coupled line 202 to ensure sufficient coupling therebetween when the directional coupler is used in Band1. On the other hand, a relatively large distance may be provided between the main line 14 and the second band coupled line 200 to prevent an excessive increase in the coupling between these lines when the directional coupler is used in Band1. In this way, these coupled lines may be spaced from the main line 14 so that the coupling of the directional coupler is substantially equalized between the two frequency bands. Generally, the power detected by the detector (in a subsequent stage) connected to the coupled port is preferably within a predetermined range regardless of the operating frequency in order to ensure sufficient detection accuracy.

Seventh Embodiment

Figure 11:
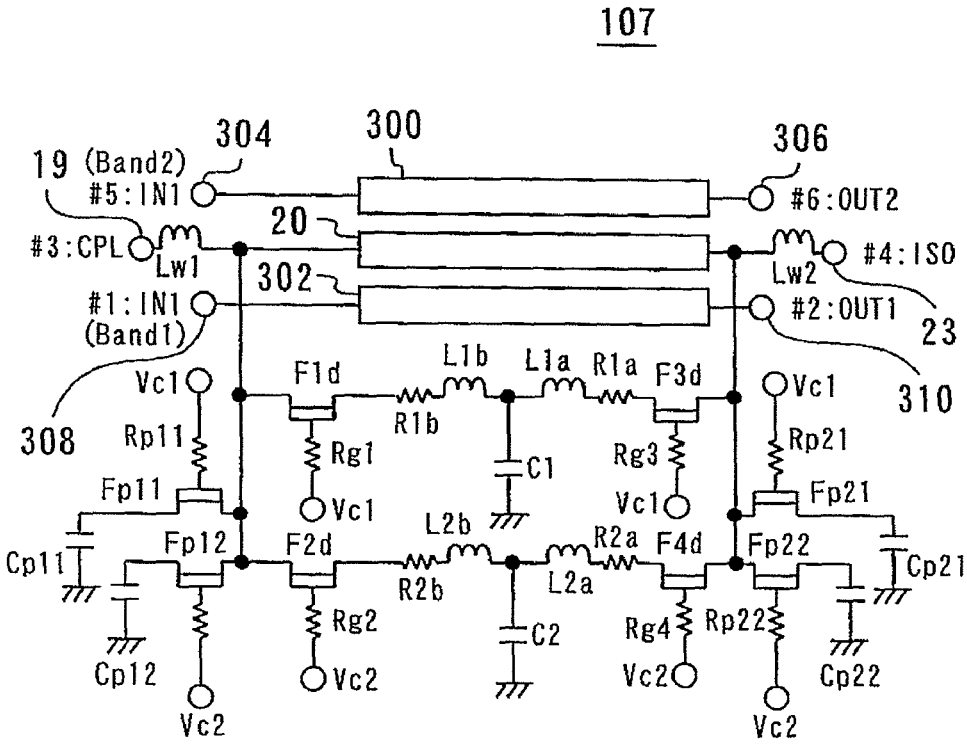
FIG. 11 is a circuit diagram of a directional coupler according to a seventh embodiment of the present invention.

FIG. 11 is a circuit diagram of a directional coupler 107 according to a seventh embodiment of the present invention. The directional coupler 107 of the present embodiment is capable of dual band operation and also includes matching capacitances of the type described in connection with the first embodiment. The directional coupler 107 differs from the directional coupler 106 of the sixth embodiment in that it includes two main lines instead of one and includes only one coupled line instead of two. In this configuration, the two main lines may be spaced at different distances from the coupled line to allow the directional coupler to operate in two bands. A part of the configuration of the seventh embodiment (which includes a dual band operation directional coupler, phase shifters, etc.) is also disclosed in detail in Japanese Patent Application No. 2009-874.

One end of a first band main line 302 is connected to a first band input port 308, and the other end is connected to a first band output port 310. One end of a second band main line 300 is connected to a second band input port 304, and the other end is connected to a second band output port 306. The second band main line 300 and the first band main line 302 are formed to sandwich the coupled line 20 therebetween.

The directional coupler 107 includes two phase shifters. Specifically, referring to FIG. 11, the phase shifter made up of components R1*b*, L1*b*, L1*a*, R1*a*, and C1 is hereinafter referred to as the "first band phase shifter." Further, the phase shifter made up of components R2*b*, L2*b*, L2*a*, R2*a*, and C2 is hereinafter referred to as the "second band phase shifter." One end of the first band phase shifter is connected to the coupled port through a first switching device F1*d*, and the other end is connected to the isolated port through a second switching device F3*d*. One end of the second band phase shifter is connected to the coupled port through a third switching device F2*d*, and the other end is connected to the isolated port through a fourth switching device F4*d*.

The directional coupler 107 includes four matching capacitive elements Cp11, Cp12, Cp21, and Cp22, as shown in FIG. 11. One end of Cp11 is connected to the coupled port through a fifth switching device Fp11, and the other end is grounded. One end of Cp12 is connected to the coupled port through a sixth switching device Fp12, and the other end is grounded. One end of Cp21 is connected to the isolated port through a seventh switching device Fp21, and the other end is grounded. One end of Cp22 is connected to the isolated port through an eighth switching device Fp22, and the other end is grounded. Like Cp1 and Cp2 of the first embodiment, Cp11, Cp12, Cp21, and Cp22 may be MIM capacitors.

Specifically, when the directional coupler is used in a first band Band1, the switching devices F1*d*, F3*d*, Fp11, and Fp21 are turned on and the switching devices F2*d*, F4*d*, Fp12, and Fp22 are turned off. When the directional coupler is used in a second band Band2, on the other hand, F1*d*, F3*d*, Fp11, and Fp21 are turned off, and F2*d*, F4*d*, Fp12, and Fp22 are turned on.

This on-off control, i.e., the turning on and off of the switching devices, is performed by a voltage apply circuit provided inside or outside the directional coupler 107. The directional coupler 107 includes a voltage apply port for each switching device as means for turning on and off the switching device. (These voltage apply ports are indicated by the reference symbols Vc1 and Vc2 in FIG. 11.)

Figure 12:
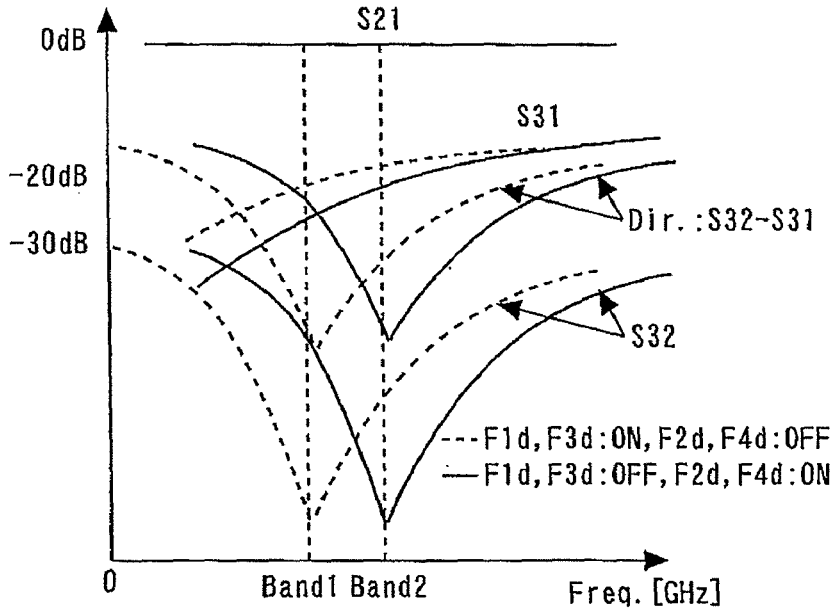
FIG. 12 illustrates a characteristic of a directional coupler according to a seventh embodiment of the present invention.

In the seventh embodiment, when one of the two main lines is to be used, the FET switching device connected to that main line is turned on and the FET switching device connected to the other main line is turned off. At that time, the FET switching devices connected to the matching capacitances may be turned on and off so that selected ones of these matching capacitances are connected to the circuit. The directional coupler includes phase shifters and attenuators for improvement of the directivity, as do the directional couplers of the fourth, fifth, and sixth embodiments. The configuration of the directional coupler 107 makes it possible to improve the directivity, as shown in FIG. 12, as well as to improve the reflection characteristics of the coupled line 20 over a wide band.

In the present embodiment, the first band phase shifter and the second band phase shifter may be used for different operating frequencies. This allows the directional coupler to have high directivity at a plurality of different operating frequencies. It should be noted that the first band main line 302 may be spaced a shorter distance from the coupled line 20 than is the second band main line 300 so that the coupling of the directional coupler is equalized between Band1 and Band2.

Eighth Embodiment

Figure 13:
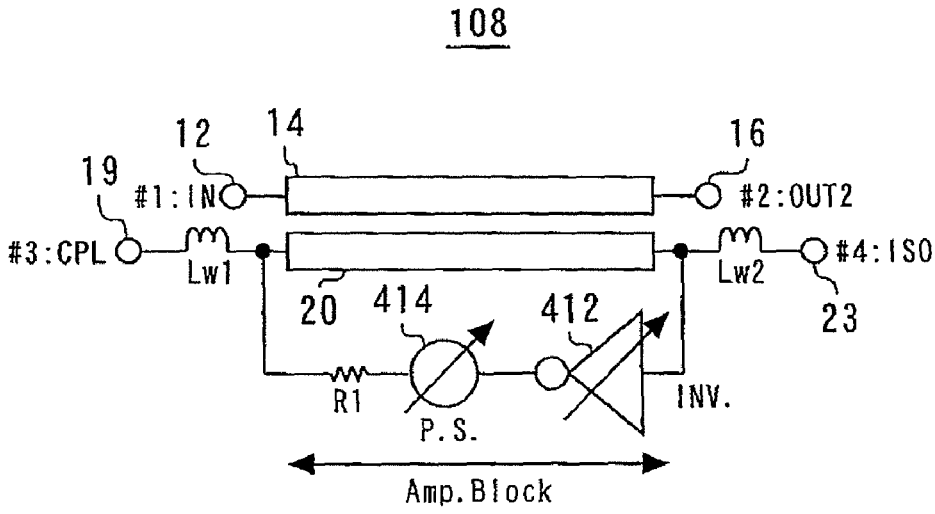
FIG. 13 is a block diagram of a directional coupler according to a eighth embodiment of the present invention.

FIG. 13 is a circuit diagram of a directional coupler 108 according to an eighth embodiment of the present invention. The directional coupler 108 includes a phase shifter (P.S.) 414 and an inverting amplifier (INV) 412 (an active device). The directional coupler 108 of the eighth embodiment further includes matching capacitances of the type described in connection with the first embodiment.

The inverting amplifier 412 has a variable gain and can attenuate an input signal and pass it to the coupled port. The gain of the inverting amplifier 412 may be adjusted to attenuate the second reflected wave component (traveling through the phase shifter) so that it has the same amplitude as the first reflected wave component (traveling through the coupled line), as in the fourth embodiment.

Figure 14:
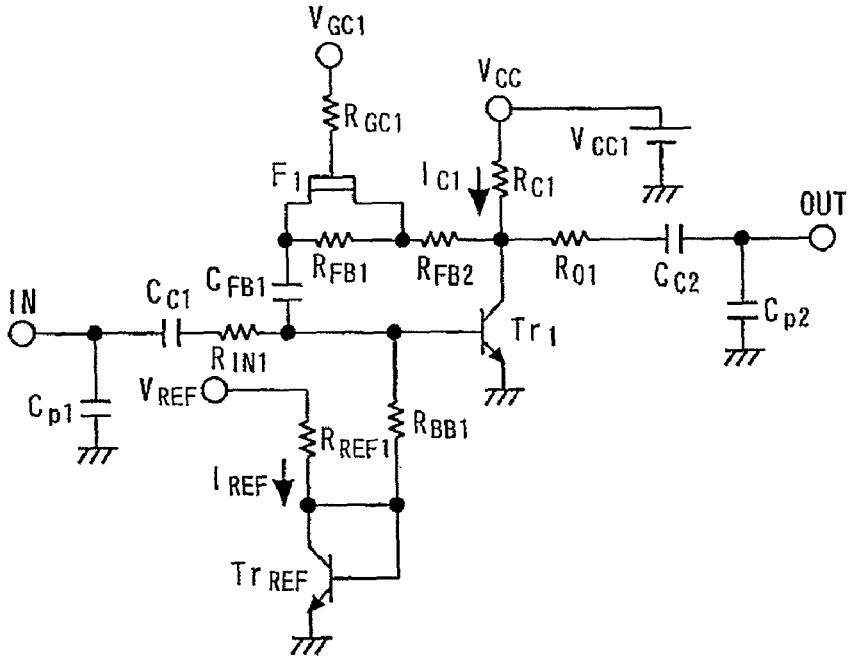
FIG. 14 is a circuit diagram of an amplifier of a directional coupler according to a eighth embodiment of the present invention.

FIG. 14 shows the detailed circuit configuration of the phase shifter (P.S.) 414 and the inverting amplifier (INV) 412 shown in FIG. 13. Referring to FIG. 14, the reference symbols Tr1 and TrREF denote HBTs (heterojunction bipolar transistors). Further, F1 denotes an FET (field effect transistor), and Rc1 denotes a load resistance. Further, the reference symbols RFB1 and RFB2 denote resistances and CFE1 denotes a capacitance; they form a feedback circuit connected between the base and collector of Tr1. The inverting amplifier 412 of the present embodiment is a variable gain circuit having an attenuation characteristic. The feedback circuit serves to increase the operating bandwidth and reduce the gain of the inverting amplifier 412. The gate voltage VGC1 of the FET F1 connected to the feedback circuit may be adjusted to adjust the on resistance of F1. In this way the amount of feedback can be varied to adjust the gain of the inverting amplifier 412. The reference symbols RIN1 and RO1 denote gain reducing resistances of the inverting amplifier 412. The values of these resistances may be such that the phase inverting amplifier 412 has an attenuation characteristic that enables the directional coupler to have high directivity. Tr1 and TrREF form a current mirror circuit. The bias current to Tr1 can be controlled by a voltage VREF. Since the conductance (gm) of Tr1 is proportional to this bias current, the gain (or the amount of attenuation) of the amplifier can be adjusted by adjusting this bias current.

In FIG. 14, the reference symbols Cp1 and Cp2 denote matching capacitances that resonate with inductances Lw1 and Lw2, respectively. The capacitance values of Cp1 and Cp2 may be such that the coupled line has improved reflection characteristics over a wide band. Further, the incorporation of the active phase shifter and the attenuator allows the directional coupler to have improved directivity over a wide band.

The use of an inverting amplifier (412) as a phase shifter, as in the eighth embodiment, is advantageous in reducing the circuit dimensions of the phase shifter. The reason for this is that since inverting amplifiers are generally made up of transistors and resistances, they can be smaller than the phase shifter of the fourth embodiment, which includes inductors and capacitive elements.

Ninth Embodiment

Figure 15:
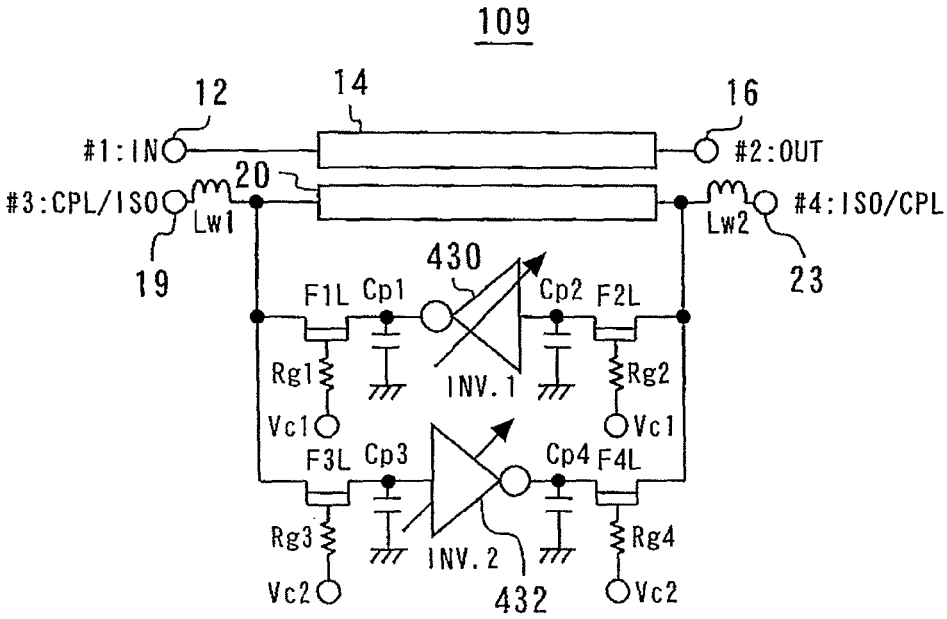
FIG. 15 is a circuit diagram of a directional coupler according to a ninth embodiment of the present invention.

FIG. 15 is a circuit diagram of a directional coupler 109 according to a ninth embodiment of the present invention. This directional coupler 109 is constructed such that when the port connected to one end of the coupled line is used as a coupled port, the port connected to the other end can be used as an isolated port, and vice versa. The directional coupler 109 of the ninth embodiment further includes matching capacitances having the same function as Cp1 and Cp2 of the first embodiment.

The directional coupler 109 includes two inverting amplifiers 430 and 432. The inverting amplifier 430 is electrically connected at its input to a port 23 and at its output to a port 19, whereas the inverting amplifier 432 is electrically connected at its input to the port 19 and at its output to the port 23. Each of these inverting amplifiers functions as a phase shifter. Thus since the inverting amplifiers 430 and 432 are electrically connected in reversed relation between the ports 19 and 23, power can be transmitted both from the input port to the output port and from the output port to the input port (i.e., bidirectional transmission) by selectively using one of the inverting amplifiers.

The inverting amplifiers 430 and 432 are variable gain inverting amplifiers. The directional coupler shown in FIG. 15 can have high directivity while being capable of bidirectional power transmission.

The output terminal of the inverting amplifier 430 is connected through a switching device F1L to the junction between the coupled line 20 and an inductance Lw1. One end of a capacitive element Cp1 is connected between the switching device F1L and the output terminal of the inverting amplifier 430. The other end of Cp1 is grounded. Further, the input terminal of the inverting amplifier 430 is connected through a switching device F2L to the junction between the coupled line 20 and an inductance Lw2. One end of a capacitive element Cp2 is connected between the switching device F2L and the input terminal of the inverting amplifier 430. The other end of Cp2 is grounded.

In a configuration similar to the circuit connected to the inverting amplifier 430, a switching device F3L and a capacitive element Cp3 are connected to the input terminal of the inverting amplifier 432, and a switching device F4L and a capacitive element Cp4 are connected to the output terminal of the inverting amplifier 432. However, the inverting amplifier 430 is electrically connected at its input terminal to the port 23 and at its output terminal to the port 19, whereas the inverting amplifier 432 is electrically connected at its input terminal to the port 19 and at its output terminal to the port 23, as described above.

When power is transmitted from the input port 12 to the output port 16, the transistors F1L and F2L are turned on and the transistors F3L and F4L are turned off. As a result, the inverting amplifier 430 operates as a phase shifter. When power is transmitted from the output port 16 to the input port 12, on the other hand, the transistors F1L and F2L are turned off and the transistors F3L and F4L are turned on. In this case, the inverting amplifier 432 operates as a phase shifter.

The capacitance values of Cp1 and Cp2 may be such that Cp1 and Cp2 resonate with Lw1 and Lw2, respectively, so that the coupled line has improved reflection loss characteristics over a wide band when power is transmitted from the input port 12 to the output port 16 (that is, when the port 19 is used as the coupled port and the port 23 is used as the isolated port). Likewise, the capacitance values of Cp3 and Cp4 may be such that Cp3 and Cp4 resonate with Lw1 and Lw2, respectively, so that the coupled line has improved reflection loss characteristics over a wide band when power is transmitted from the output port 16 to the input port 12 (that is, when the port 23 is used as the coupled port and the port 19 is used as the isolated port). Further, the incorporation of the active phase shifters and attenuators allows the directional coupler to have improved directivity over a wide band.

Tenth Embodiment

Figure 16:
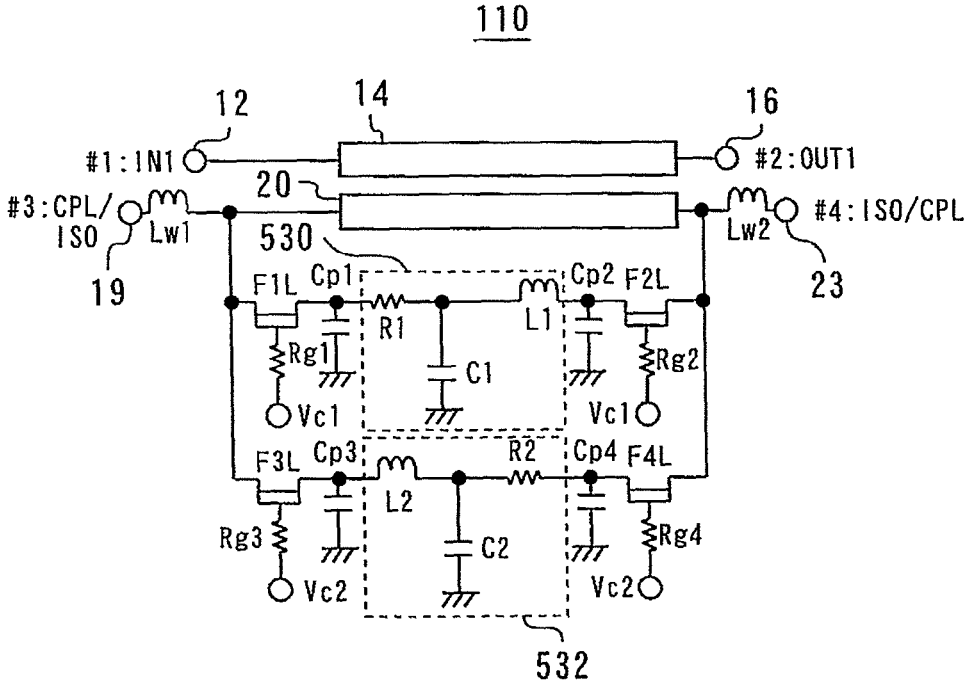
FIG. 16 is a circuit diagram of a directional coupler according to a tenth embodiment of the present invention.
Figure 17A:
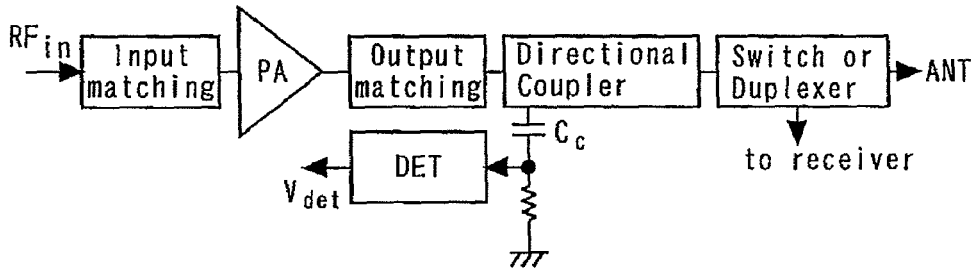
FIG. 17 shows an example of a monitoring system of power for a wireless terminal.
Figure 17B:
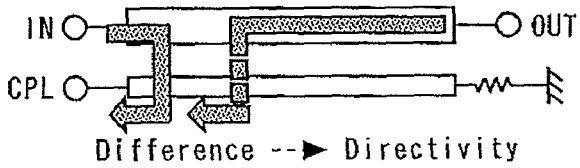
Figure 18:
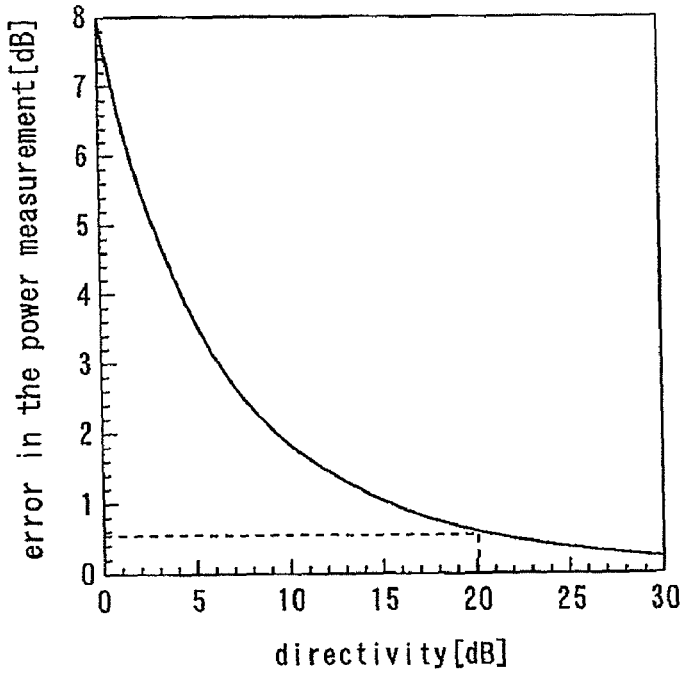
FIG. 18 shows an exemplary relationship between the directivity of the directional coupler and the error in the power measurement.
Figure 19:
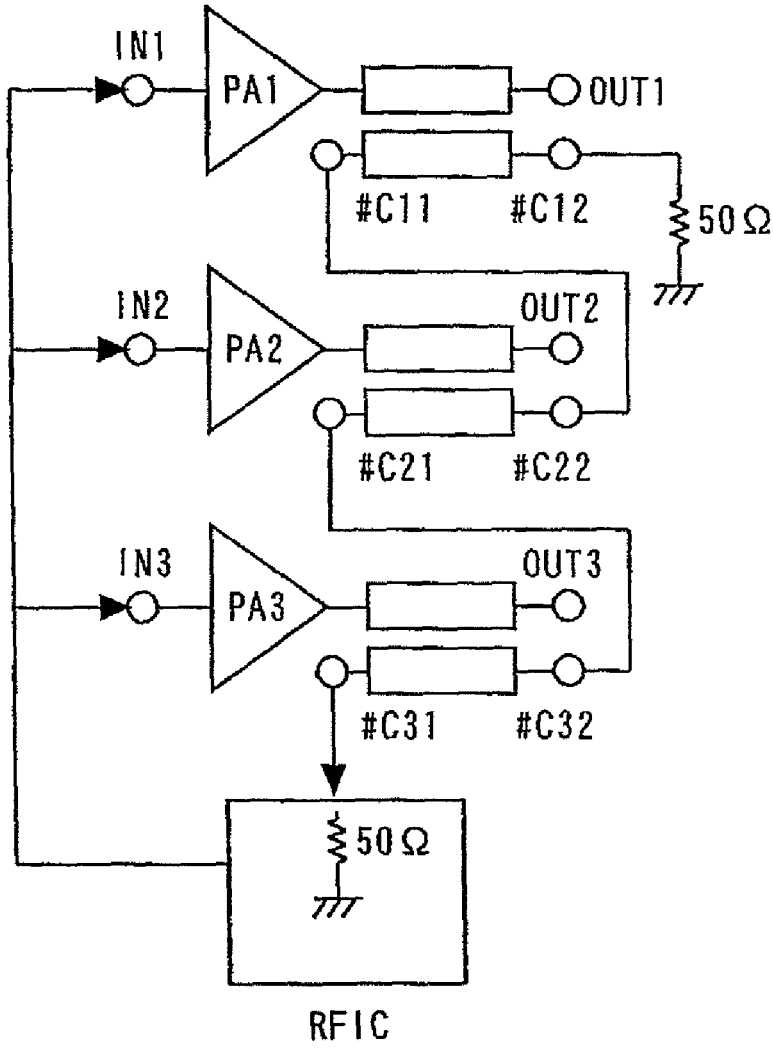
FIG. 19 shows an exemplary application of power amplifiers and directional couplers.
Figure 20:
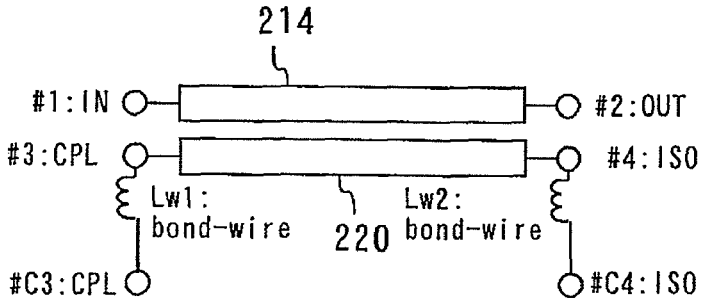
FIG. 20 is an exemplary circuit diagram of an on-chip type directional coupler.
Figure 21:
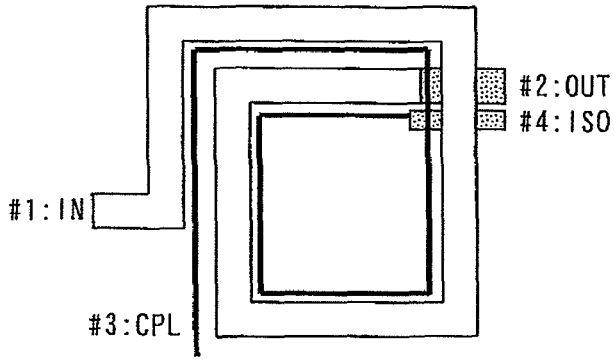
FIG. 21 illustrates an exemplary circuit pattern of an on-chip type directional coupler.

FIG. 16 is a circuit diagram of a directional coupler 110 according to a tenth embodiment of the present invention. This directional coupler 110, like the directional coupler 109 of the ninth embodiment, is constructed such that when the port connected to one end of the coupled line is used as a coupled port, the port connected to the other end can be used as an isolated port, and vice versa. However, the phase shifters of the tenth embodiment differ in configuration from those of the ninth embodiment.

Referring to FIG. 16, the circuit consisting of components R1, C1, and L1 forms a phase shifter 530. Likewise, the circuit consisting of components R2, C2, and L2 forms a phase shifter 532. The directional coupler 110 is similar to the directional coupler 109 of the ninth embodiment, except that the inverting amplifiers 430 and 432 are replaced by the phase shifters 530 and 532.

The directional coupler 110 of the tenth embodiment also further includes capacitive elements having the same function as the matching capacitances Cp1 and Cp2 of the first embodiment. The capacitance values of capacitive elements Cp1 and Cp2 in this embodiment may also be such that Cp1 and Cp2 resonate with inductances Lw1 and Lw2, respectively, so that the coupled line has improved reflection loss characteristics over a wide band when power is transmitted from the input port 12 to the output port 16 (that is, when the port 19 is used as the coupled port and the port 23 is used as the isolated port). Likewise, the capacitance values of capacitive elements Cp3 and Cp4 in this embodiment may also be such that Cp3 and Cp4 resonate with Lw1 and Lw2, respectively, so that the coupled line has improved reflection loss characteristics over a wide band when power is transmitted from the output port 16 to the input port 12 (that is, when the port 23 is used as the coupled port and the port 19 is used as the isolated port). Further, the incorporation of the phase shifters and attenuators allows the directional coupler to have improved directivity over a wide band.

Eleventh Embodiment

A directional coupler according to an eleventh embodiment of the present invention differs from the directional coupler 108 of the eighth embodiment (see FIGS. 13 and 14) in that the capacitive elements Cp1 and Cp2 are replaced by variable capacitance elements Cpv1 and Cpv2. As a result, the directional coupler of the present embodiment has the advantages of the directional coupler 103 of the third embodiment, as well as the advantages of the directional coupler 108. Further, in the directional coupler of each embodiment described above, some or all of the matching capacitive elements (Cp1, Cp2, etc.) may be replaced by variable capacitance elements.

As described above, the directional couplers of the first to eleventh embodiments are constructed such that capacitive components connected to the coupled line 20 resonate with parasitic inductive components Lw1 and Lw2 including wires (or connecting elements) connected between the chip and the module substrate and including transmission lines on the module substrate, etc. This prevents an increase in the reflection loss in the coupled line 20 and thereby improves its reflection loss characteristics over a wide band. Therefore, directional couplers of one of the types described in connection with the embodiments may be used as the directional couplers in a multiband-capable terminal. This allows the coupled lines of these directional couplers to be connected in series to one another, since the coupled lines have improved reflection loss characteristics. In other words, in the case of a multiband-capable terminal in which the coupled lines of the directional couplers are connected in series to one another, the wave detecting circuit can still exhibit good detection characteristics if these directional couplers are of one of the types described in connection with the present invention.

It may be noted that in the description and drawings of the first to eleventh embodiments, like reference symbols are sometimes used to denote like or corresponding resistances, inductances, and capacitive elements, for convenience. For example, the reference symbols Cp1, Cp2, Cp3, and Cp4 are used to denote matching capacitive elements in several embodiments. However, this does not necessarily means that the capacitive elements denoted by the same reference symbol have the same capacitance value, for example. That is, each component may have any suitable resistance, inductance, or capacitance value determined by the circuit configuration of the embodiment in which it is used. For instance, the values of the capacitive elements in the embodiments may be selected such that the coupled line 20 has good reflection loss characteristics over a wide band.

Obviously many modifications and variations of the present invention are possible in the light of the above teachings. It is therefore to be understood that within the scope of the appended claims the invention may by practiced otherwise than as specifically described.

The entire disclosure of a Japanese Patent Application No. 2009-208274, filed on Sep. 9, 2009 including specification, claims, drawings and summary, on which the Convention priority of the present application is based, are incorporated herein by reference in its entirety.

What is claimed is:

1. A directional coupler comprising:

a main line located on a substrate, said main line having a first end connected to an input port, and a second end connected to an output port;

a coupled line located on said substrate and extending along said main line, said coupled line having a first end located at the same side of said directional coupler as said input port and connected to a coupled port, and a second end located at the same side of said directional coupler as said output port and connected to an isolated port, wherein coupling length between said coupled line and said main line is shorter than one-quarter wavelength of power transmitted from said input port to said output port;

a first capacitive element located on said substrate and having a first end connected between said coupled port and said first end of said coupled line, and a second end connected to ground;

a second capacitive element located on said substrate and having a first end connected between said isolated port and said second end of said coupled line, and a second end connected to ground; and a phase shifter having a first end connected between said isolated port and said first end of said second capacitive element, and a second end connected between said coupled port and said first end of said first capacitive element, wherein said phase shifter phase shifts a second reflected wave component such that the second reflected wave component is opposite in phase with respect to a first reflected wave component, the second reflected wave component traveling from said output port to said coupled port through said isolated port and said phase shifter, and the first reflected wave component traveling from said output port to said coupled port through said coupled line, and includes an inverting amplifier having a first end connected between said isolated port and said first end of said second capacitive element, and a second end connected between said coupled port and said first end of said first capacitive element.

2. A directional coupler comprising:

a main line located on a substrate, said main line having a first end connected to an input port, and a second end connected to an output port;

a coupled line located on said substrate and extending along said main line, said coupled line having a first end located at the same side of said directional coupler as said input port and connected to a coupled port, and a second end located at the same side of said directional coupler as said output port and connected to an isolated port, wherein coupling length between said coupled line and said main line is shorter than one-quarter wavelength of power transmitted from said input port to said output port;

a first capacitive element located on said substrate and having a first end connected between said coupled port and said first end of said coupled line, and a second end connected to ground;

a second capacitive element located on said substrate and having a first end connected between said isolated port and said second end of said coupled line, and a second end connected to ground; and a phase shifter having a first end connected between said isolated port and said first end of said second capacitive element, and a second end connected between said coupled port and said first end of said first capacitive element, wherein said phase shifter phase shifts a second reflected wave component such that the second reflected wave component is opposite in phase with respect to a first reflected wave component, the second reflected wave component traveling from said output port to said coupled port through said isolated port and said phase shifter, and the first reflected wave component traveling from said output port to said coupled port through said coupled line, and includes a series circuit including a first resistance, a first inductive element, a second inductive element, and a second resistance connected in series, in that order, between a junction of said isolated port and said first end of said second capacitive element, and a junction of said coupled port and said first end of said first capacitive element, and a capacitive element having a first end connected between said first and second inductive elements, and a second end connected to ground.

3. A directional coupler comprising:

a main line located on a substrate, said main line having a first end connected to an input port, and a second end connected to an output port;

a coupled line located on said substrate and extending along said main line, said coupled line having a first end located at the same side of said directional coupler as said input port and connected to a coupled port, and a second end located at the same side of said directional coupler as said output port and connected to an isolated port, wherein coupling length between said coupled line and said main line is shorter than one-quarter wavelength of power transmitted from said input port to said output port;

a first capacitive element located on said substrate and having a first end connected between said coupled port and said first end of said coupled line, and a second end connected to ground;

a second capacitive element located on said substrate and having a first end connected between said isolated port and said second end of said coupled line, and a second end connected to ground;

a phase shifter having a first end connected between said isolated port and said first end of said second capacitive element, and a second end connected between said coupled port and said first end of said first capacitive element, wherein said phase shifter phase shifts a second reflected wave component such that the second reflected wave component is opposite in phase with respect to a first reflected wave component, the second reflected wave component traveling from said output port to said coupled port through said isolated port and said phase shifter, and the first reflected wave component traveling from said output port to said coupled port through said coupled line, said directional coupler is used in a first band and a second band that is higher in frequency than the first band, and said coupled line includes a coupled port-side coupled line having first and second ends with said first end connected to said coupled port, an isolated port-side coupled line having first and second ends with said first end connected to said isolated port, and a first switching device connected between said second end of said coupled port-side coupled line and said second end of said isolated port-side coupled line so that said second end of said coupled port-side coupled line and said second end of said isolated port-side coupled line can be electrically connected to and disconnected from each other;

a second switching device connected between said first end of said phase shifter and said second end of said coupled port-side coupled line; and third, fourth, fifth, and sixth switching devices, wherein said first capacitive element includes a first coupled port-side capacitive element and a second coupled port-side capacitive element that are located on said substrate, wherein said first coupled port-side capacitive element has first and second ends and is connected at said first end through said third switching device to a junction between said coupled port and said first end of said coupled port-side coupled line, and is connected at said second end to ground, and said second coupled port-side capacitive element has first and second ends and is connected at said first end through said fourth switching device to a junction between said coupled port and said first end of said coupled port-side coupled line, and is connected at said second end to ground, and said second capacitive element includes a first isolated port-side capacitive element and a second isolated port-side capacitive element that are located on said substrate, wherein said first isolated port-side capacitive element has first and second ends and is connected at said first end through said fifth switching device to a junction between said isolated port and said first end of said isolated port-side coupled line, and is connected at said second end to ground, and said second isolated port-side capacitive element has first and second ends and is connected at said first end through said sixth switching device to a junction between said isolated port and said first end of said isolated port-side coupled line, and is connected at said second end to ground.

4. A directional coupler comprising:

a main line located on a substrate, said main line having a first end connected to an input port, and a second end connected to an output port;

a coupled line located on said substrate and extending along said main line, said coupled line having a first end located at the same side of said directional coupler as said input port and connected to a coupled port, and a second end located at the same side of said directional coupler as said output port and connected to an isolated port, wherein coupling length between said coupled line and said main line is shorter than one-quarter wavelength of power transmitted from said input port to said output port;

a first capacitive element located on said substrate and having a first end connected between said coupled port and said first end of said coupled line, and a second end connected to ground;

a second capacitive element located on said substrate and having a first end connected between said isolated port and said second end of said coupled line, and a second end connected to ground;

a phase shifter having a first end connected between said isolated port and said first end of said second capacitive element, and a second end connected between said coupled port and said first end of said first capacitive element, wherein said phase shifter phase shifts a second reflected wave component such that the second reflected wave component is opposite in phase with respect to a first reflected wave component, the second reflected wave component traveling from said output port to said coupled port through said isolated port and said phase shifter, and the first reflected wave component traveling from said output port to said coupled port through said coupled line, and said directional coupler is used in a first band and a second band that is higher in frequency than the first band; and first, second, third, fourth, fifth, sixth, seventh, and eighth switching devices, wherein said coupled line includes a first band coupled line having first and second ends and a second band coupled line having first and second ends, said first band coupled line and said second band coupled line being located along and sandwiching said main line, said coupled port is connected to said first end of said first band coupled line through said first switching device and is connected to said first end of said second band coupled line through said second switching device, said isolated port is connected to said second end of said first band coupled line through said third switching device, and is connected to said second end of said second band coupled line through said fourth switching device, said first capacitive element includes a first coupled port-side capacitive element and a second coupled port-side capacitive element located on said substrate, wherein said first coupled-port side capacitive element has first and second ends and is connected at said first end to said coupled port through said fifth switching device, and is connected at said second end to ground, and said second coupled port-side capacitive element has first and second ends and is connected at said first end to said coupled port through said sixth switching device, and is connected at said second end to ground, and said second capacitive element includes a first isolated port-side capacitive element and a second isolated port-side capacitive element that are located on said substrate, wherein said first isolated port-side capacitive element has first and second ends and is connected at said first end to said isolated port through said seventh switching device, and is connected at said second end to ground, and said second isolated port-side capacitive element has first and second ends and is connected at said first end to said isolated port through said eighth switching device, and is connected at said second end to ground.

5. A directional coupler comprising:

a main line located on a substrate, said main line having a first end connected to an input port, and a second end connected to an output port;

a coupled line located on said substrate and extending along said main line, said coupled line having a first end located at the same side of said directional coupler as said input port and connected to a coupled port, and a second end located at the same side of said directional coupler as said output port and connected to an isolated port, wherein coupling length between said coupled line and said main line is shorter than one-quarter wavelength of power transmitted from said input port to said output port;

a first capacitive element located on said substrate and having a first end connected between said coupled port and said first end of said coupled line, and a second end connected to ground;

a second capacitive element located on said substrate and having a first end connected between said isolated port and said second end of said coupled line, and a second end connected to ground;

a phase shifter having a first end connected between said isolated port and said first end of said second capacitive element, and a second end connected between said coupled port and said first end of said first capacitive element, wherein said phase shifter phase shifts a second reflected wave component such that the second reflected wave component is opposite in phase with respect to a first reflected wave component, the second reflected wave component traveling from said output port to said coupled port through said isolated port and said phase shifter, and the first reflected wave component traveling from said output port to said coupled port through said coupled line, said directional coupler is used in a first band and a second band that is higher in frequency than the first band, said main line includes a first band main line having a first band input port and a first band output port, and a second band main line having a second band input port and a second band output port, wherein said first and second band main lines sandwich said coupled line, said first band main line has first and second ends and is connected at said first end to said first band input port, and at said second end to said first band output port, and said second band main line has first and second ends and is connected at said first end to said second band input port, and is connected at said second end to said second band output port; and first, second, third, fourth, fifth, sixth, seventh, and eighth switching devices, wherein said phase shifter includes a first band phase shifter and a second band phase shifter, wherein said first band phase shifter has first and second ends and is connected at said first end to said coupled port through said first switching device, and is connected at said second end to said isolated port through said second switching device, and said second band phase shifter has first and second ends and is connected at said first end to said coupled port through said third switching device, and is connected at said second end to said isolated port through said fourth switching device, said first capacitive element includes a first coupled port-side capacitive element and a second coupled port-side capacitive element located on said substrate, wherein said first coupled-port side capacitive element has first and second ends and is connected at said first end to said coupled port through said fifth switching device, and is connected at said second end to ground, and said second coupled port-side capacitive element has first and second ends and is connected at said first end to said coupled port through said sixth switching device, and is connected at said second end to ground, and said second capacitive element includes a first isolated port-side capacitive element and a second isolated port-side capacitive element located on said substrate, wherein said first isolated port-side capacitive element has first and second ends and is connected at said first end to said isolated port through said seventh switching device, and is connected at said second end to ground, and said second isolated port-side capacitive element has first and second ends and is connected at said first end to said isolated port through said eighth switching device, and is connected at said second end to ground.

* * * * *